US005720132A

United States Patent [19]

Renner et al.

[11] Patent Number: 5,720,132

[45] Date of Patent: Feb. 24, 1998

[54] FENCE GATE OPENER WITH FLUID GRAVITY CLOSURE ASSEMBLY

[76] Inventors: David L. Renner, HCR 1, Box 11, Wallace, Kans. 67761; Murry E. Renner, Rte. 2, Box 2470M, Granby, Mo. 64844

[21] Appl. No.: 621,713

[22] Filed: Mar. 28, 1996

[51] Int. Cl.[6] ..... E05F 13/04

[52] U.S. Cl. ..... 49/263; 49/265; 49/273

[58] Field of Search ..... 49/263, 264, 265, 49/269, 270, 273, 271, 274, 385, 331, 137, 30

[56] References Cited

U.S. PATENT DOCUMENTS

| | | | |
|---|---|---|---|
| 1,672,723 | 6/1928 | McClary | 49/274 X |
| 2,166,743 | 7/1939 | Miller | 49/265 X |
| 2,293,462 | 8/1942 | Haynes | 49/265 X |
| 3,041,759 | 7/1962 | Treiber | 49/274 |
| 4,521,992 | 6/1985 | Campbell | 49/271 X |
| 5,067,276 | 11/1991 | Brandt, Sr. | 49/273 X |

*Primary Examiner*—Kenneth J. Dorner
*Assistant Examiner*—Curtis Cohen
*Attorney, Agent, or Firm*—Phillip A. Rein

[57] ABSTRACT

A fence gate opener with fluid gravity closure assembly having 1) a main closure gate assembly with a main gate assembly; 2) a main support base assembly operable to be connected to a ground support surface and having the main gate assembly pivotally connected thereto; 3) a fluid gravity closure assembly operably connected to the main support base assembly and the main gate assembly for pivotal movement therewith; and 4) a gate actuator treadle assembly operably connected to the main support base assembly and the main gate assembly to cause pivotal movement thereof from the opened to the closed conditions. The main closure gate assembly includes a counterbalance weight assembly being rotatable with the main gate assembly on a pivot shaft member from opened to closed conditions of the main gate assembly. The main support base assembly includes a support frame assembly having a pivotal gate support assembly connected thereto. The fluid gravity closure assembly includes a weight transfer fluid tank assembly having a sealed fluid flow system with three tank members operable to 1) have fluid flow from a first tank member to a second tank member in the opened condition; and 2) have controlled fluid flow from the second tank member to a third tank member and back to the second tank member to provide a controlled movement of the main gate assembly from the opened to the closed conditions. The gate actuator treadle assembly can be a mechanical actuator treadle assembly or a hydraulic actuator treadle assembly which can be used on irregular terrain ground support surfaces.

14 Claims, 9 Drawing Sheets

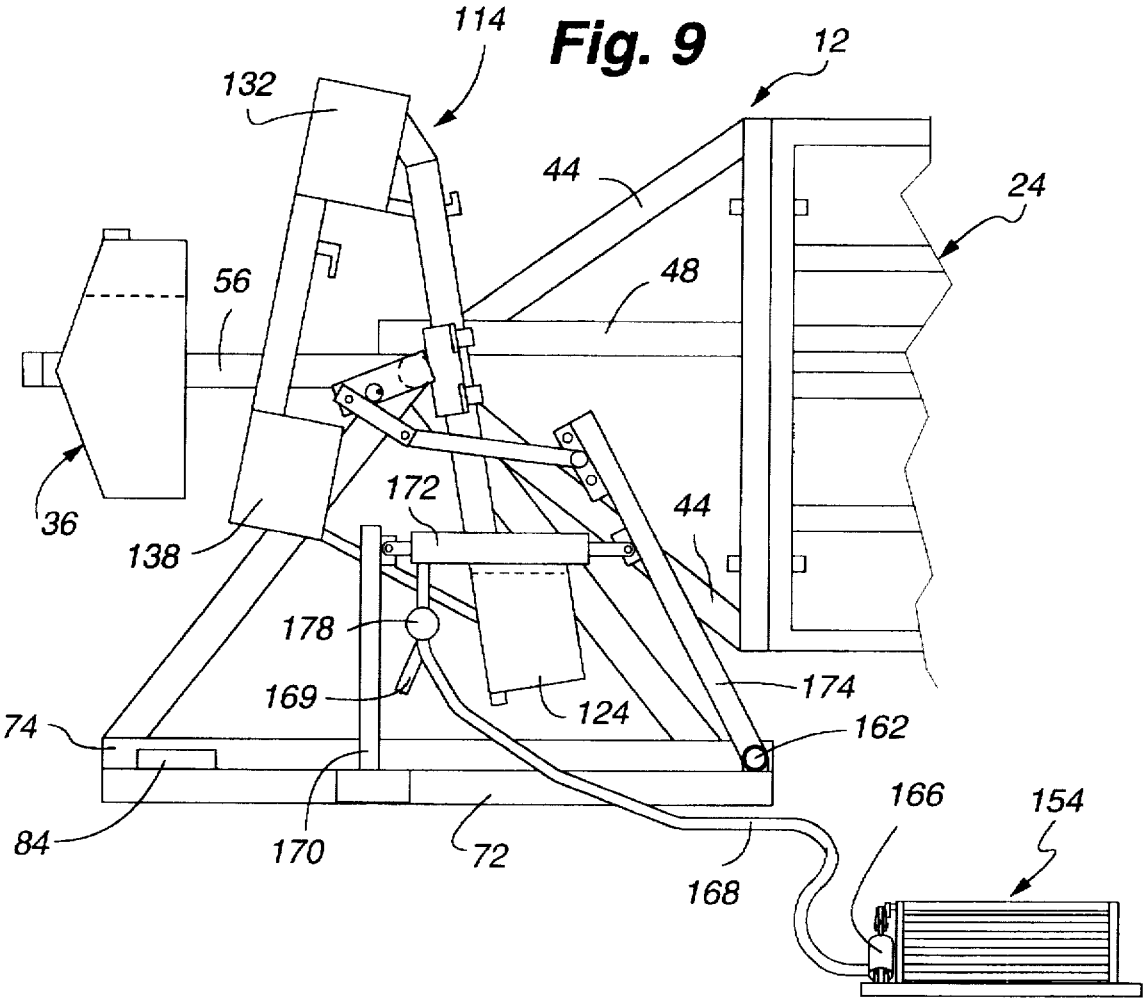
Fig. 10
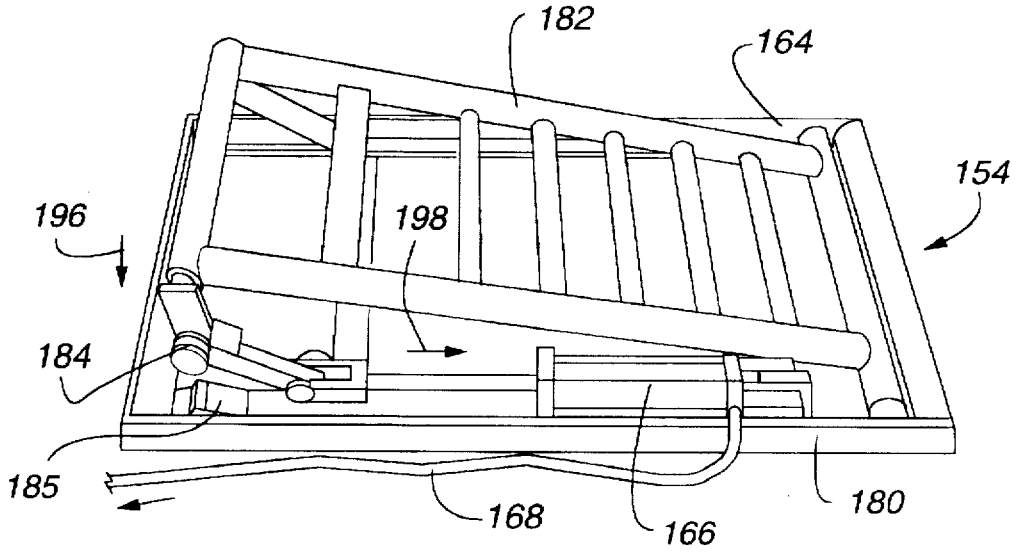

Fig. 11
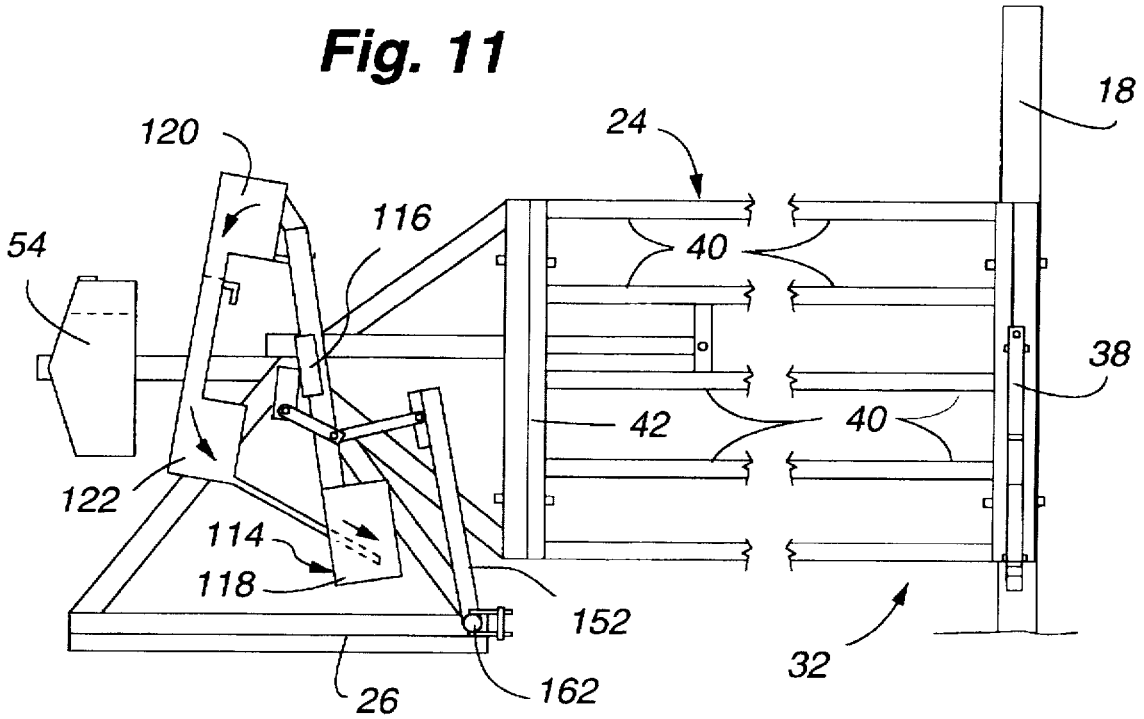
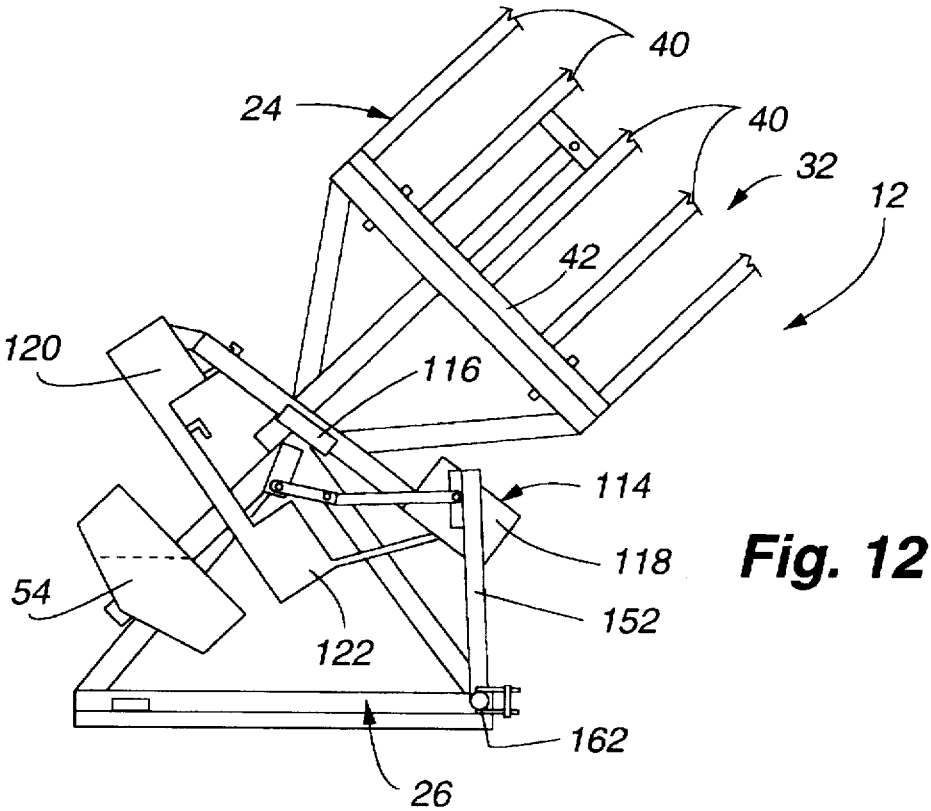
Fig. 12

FENCE GATE OPENER WITH FLUID GRAVITY CLOSURE ASSEMBLY

PREFERRED EMBODIMENT OF THE INVENTION

In one preferred embodiment of this invention, a fence gate opener with fluid gravity closure assembly is operable with a fencing assembly to be placed between two spaced fence posts which are supported in a ground support surface. The fence gate opener with gravity closure assembly is operable to open and close a main gate assembly without requiring the use of an external power supply, such as an electrical power source, and will operate under a fluid gravity flow in conjunction with a gate actuator treadle assembly to move the main gate assembly from a closed to an opened condition in a controlled manner.

The fence gate opener with fluid gravity closure assembly is operable to be readily activated through 1) the placement of a vehicle tire member on a gate actuator treadle assembly; and 2) the lifting of a portion of the main gate assembly by a person, either on foot or horseback, to raise the main gate assembly from the closed to the opened condition to the closed condition which is easily accomplished due to counterbalance weight features to be noted herein.

The fence gate opener with fluid gravity closure assembly includes 1) a main closure gate assembly to be mounted between spaced fence posts; 2) a main support base assembly operable to be connected to a ground support surface and having the main closure gate assembly pivotally connected thereto; 3) a fluid gravity closure assembly connected to the main closure gate assembly and pivotally connected to a portion of the main support base assembly for movement by gravity fluid flow front the opened condition back to the closed condition; and 4) a gate actuator treadle assembly operably connected to the fluid gravity closure assembly and the main closure gate assembly to cause movement of a main gate assembly from a closed to an opened condition achieved in a controlled and adjustable manner through the fluid gravity closure assembly.

The main closure gate assembly includes 1) a main gate assembly operable to cover a fence opening of 12 to 16 feet between fence posts having vertical and horizontal support members to provide a barrier to movement of cattle and other items therethrough; 2) a pivot support assembly connected to the main gate assembly and further to the main support base assembly; 3) a counterbalance weight assembly connected to a portion of the main support base assembly; and 4) a gate guide and support assembly connected to a fence post adjacent the fence opening and operable to receive and support a portion of the main gate assembly when moved to the closed condition.

The counterbalance weight assembly is provided with a counterbalance tank member adjustably mounted on a tank support shaft and adapted to receive a fluid, such as water with antifreeze therein, which will allow opening and closing of the main gate assembly with a minimum amount of effort required in a manner to be explained.

The main support base assembly includes 1) a support frame assembly which is anchored to the ground support surface as by stakes; and 2) a gate support pivot assembly which is pivotally mounted on the support frame assembly.

The support frame assembly includes interconnected main support channels anchored to the ground support surface by the stabilizer stakes and having pivot connector sleeves to which the gate support pivot assembly is pivotally connected.

The gate support pivot assembly includes a horizontal support assembly having a vertical support connected thereto with the horizontal support assembly having 1) a main support member; 2) a transverse support member having one end connected to the main support member; and 3) a guide support member connected at outer ends to the main support member and the transverse support member. The main support member is pivotally connected to the pivot connector sleeves so as to be rotational thereabout.

The vertical support assembly includes 1) inclined forward support members anchored to respective opposite outer end sections of the main support member; 2) an inclined rearward support member anchored to an outer end of the guide support member; and 3) a main upper gate pivot support member secured to upper ends of the forward support members and the rearward support member so as to provide a main pivot point or axis about which the main gate assembly will be pivoted as will be explained.

The fluid gravity closure assembly includes 1) a weight transfer fluid tank assembly; and 2) a pivot shaft connector assembly connected to the weight transfer fluid tank assembly, the counterbalance weight assembly, the main gate pivot support member, and the gate actuator treadle assembly as will be explained.

The weight transfer fluid tank assembly includes a main fluid storage tank assembly being operably connected to a main fluid holding tank assembly which is operably connected to a main fluid auxiliary tank assembly which, in turn, is operably connected back to the main fluid storage tank assembly.

The weight transfer fluid tank assembly is operable to have a fluid therein, such as water with antifreeze, which is moved between the tank assemblies in a controlled fluid flow manner under normal force of gravity which is operable 1) to hold the main gate assembly in the opened condition; 2) to allow the main gate assembly to move in an adjustable controlled manner from the opened to the closed conditions; and 3) hold the main gate assembly in the closed condition.

All of the tank assemblies are interconnected to each other by the transfer tubes or pipes and fluid flow in a controlled manner through a closure control valve member mounted between the main fluid holding tank assembly and the main fluid auxiliary tank assembly controls the time period between the opened and closed conditions.

The pivot shaft connector assembly includes 1) a pivot shaft member mounted within the main gate pivot support member of the gate support pivot assembly for selective rotational movement therein; 2) a connector clamp member connected with a storage tank tube connector or bracket to a storage transfer tube so that the entire weight transfer fluid tank assembly is pivotal with the pivot shaft member on rotation thereof; 3) a shaft connector member connected to an outer end of the pivot shaft member; 4) a cam eccentric member connected to the shaft connector member to adjust rotation thereof as will be explained; 5) a first pivot arm or link pivotally connected to an outer end of the shaft connector member; and 6) a second pivot arm or link pivotally connected to an outer end of the first pivot arm and engageable with the cam eccentric member to control adjustable rotational movement of the pivot shaft member as will be noted.

The gate actuator treadle assembly has two embodiments being 1) a mechanical actuator treadle assembly; and 2) a hydraulic actuator treadle assembly.

The mechanical actuator treadle assembly includes 1) a main treadle frame assembly which is mounted on a ground support surface in a manner to receive a front wheel member of a vehicle thereon to cause actuation thereof; 2) a roller actuator assembly operably connected to a portion of the main treadle frame assembly; 3) an actuator arm member connected to the roller actuator assembly; 4) a drive line shaft member connected to an outer end of the actuator arm member; and 5) a support post connected to and rotatable with the drive line shaft member.

The roller actuator assembly is operable to move the actuator arm member which, in turn, rotates the drive line shaft member to pivot the support post which rotates the pivot shaft member to move the main gate assembly from the closed to the opened conditions.

The hydraulic actuator treadle assembly includes 1) a main treadle frame assembly to receive the front wheel member of a vehicle member thereon; 2) a piston and cylinder actuator assembly connected to the main treadle frame assembly operable to be actuated on downward pivotal movement of a portion of the main treadle frame assembly; 3) a transfer hose member connected to the piston and cylinder actuator assembly; 4) a main support post connected to a portion of the main support base assembly; 5) a pivotal piston and cylinder actuator assembly connected to the main support post; 6) an actuator post member pivotally connected to the main support base assembly and connected to an outer portion of the pivotal piston and cylinder actuator assembly; and 7) an upper end of the actuator post member is pivotally connected to an outer end of the second pivot arm of the pivot shaft connector assembly and a mid section is pivotally connected to an outer end of the pivotal piston and cylinder actuator assembly.

The transfer hose member is provided with a restrictor valve therein so as to achieve controlled and timed closure of the main gate assembly when moving from the opened to the closed conditions.

Further, when two of the main treadle frame assemblies are placed on opposite sides of the main gate assembly, they will be interconnected by the transfer hose members and a common actuator hose member. The restrictor valve is mounted in the common actuator hose member so that the operation of one of the hydraulic actuator treadle assemblies can be connected to each other to achieve operation from either side of the main gate assembly.

Depression of one of the main treadle frame assemblies causes fluid flow from the piston and cylinder actuator assembly in the depressed main treadle frame assembly to the pivotal piston and cylinder actuator assembly. this, in turn, causes outer pivotal movement of the main support post with rotation of the pivot shaft member to rotate the main gate assembly from the closed to the opened condition.

OBJECTS OF THE INVENTION

One object of this invention is to provide a fence gate opener with fluid gravity closure assembly which can be readily mounted between a pair of spaced fence posts and being operable to move a main gate assembly from a closed to an opened condition through operation of an actuator treadle assembly by a front tire member of a motor vehicle and, after passage of the motor vehicle therethrough, the main gate assembly is movable in a timed adjustable controlled manner from the opened to the closed conditions without requiring the vehicle driver to leave the motor vehicle and does not require an external power source for operation thereof.

One other object of this invention is to provide a fence gate opener with fluid gravity closure assembly which can be placed in a remote location without any utilities required and operable to be moved from an opened to a closed condition in a timed adjustable manner utilizing only movement of a fluid under force of gravity between fluid tank members to achieve a controlled operation including 1) holding a main gate assembly in the opened condition; and 2) allowing the main gate assembly to be moved in a controlled adjustable speed manner to a closed condition.

Another object of this invention is to provide a fence gate opener with fluid gravity closure assembly which is easily connected to a ground support surface and having a main gate assembly in combination with an interconnected counterbalance weight assembly so that a heavy main gate assembly can be moved from the closed to the opened conditions with little force applied to the main gate assembly by a person on foot or horseback and further moved to the closed condition automatically.

One other object of this invention is to provide a fence gate opener with fluid gravity closure assembly which is provided with a gate actuator treadle assembly to be actuated by a front tire member of a vehicle and having the option of 1) being mechanically operable through a mechanical linkage assembly; or 2) being hydraulically operable through the use of a pressure fluid flowing between a pair of piston and cylinder actuator assemblies.

A further object of this invention is to provide a fence gate opener with fluid gravity closure assembly utilizing a fluid gravity closure assembly having interconnected tank assemblies to allow fluid flow therebetween and 1) having a control valve member which can be selectively operated to control the speed of closure of an opened main gate assembly; or 2) the control valve member can be completely closed to hold the main gate assembly in the opened condition which may be desirable when driving cattle therethrough and the like.

One further object of this invention is to provide a fence gate opener with fluid gravity closure assembly including 1) an adjustable counterbalance weight assembly to be filled with a fluid to control an amount of force necessary to be applied to open a main gate assembly; 2) the counterbalance weight assembly which can be used to regulate the force required to open and the speed of closing of the main gate assembly; 3) a closure control member to hold the main gate assembly in the opened condition or to regulate the speed of movement of the main gate assembly from the opened to the closed condition.

One other object of this invention is to provide a fence gate opener with fluid gravity closure assembly including a main support base assembly operably connected to a main gate assembly and having a means thereon to act as a shock absorbing feature to allow a controlled pivotal movement of the main support base assembly and interconnected main gate assembly to prevent damage thereto during opening and closing of the main gate assembly which may be of considerable size and weight.

Still, one further object of this invention is to provide a fence gate opener with fluid gravity closure assembly which can be readily installed in a location that does not require an external power source; can be used with a hydraulic actuator treadle assembly so that it is not dependent on smooth terrain for operation thereof; is economical to manufacture; is reliable in operation; is easy to install; and substantially maintenance free.

Various other objects, advantages, and features of the invention will become apparent to those skilled in the art from the following discussion, taken in conjunction with the accompanying drawings, in which:

FIGURES OF THE INVENTION

FIG. 9 is a side elevational view similar to FIG. 7 illustrating use of a hydraulic actuator treadle assembly;

FIG. 10 is a perspective view of a main treadle frame assembly of the hydraulic actuator treadle assembly;

Figure 13:
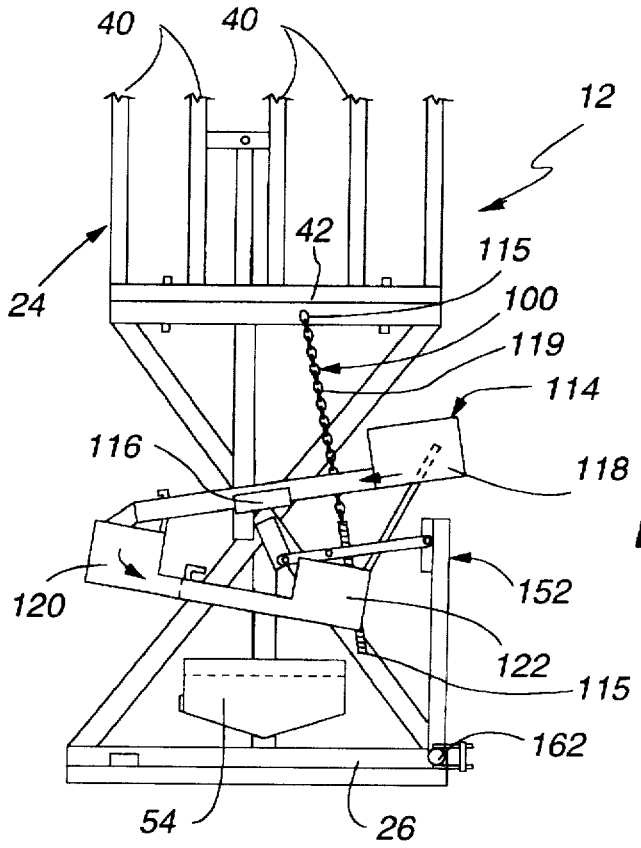
Figure 14:
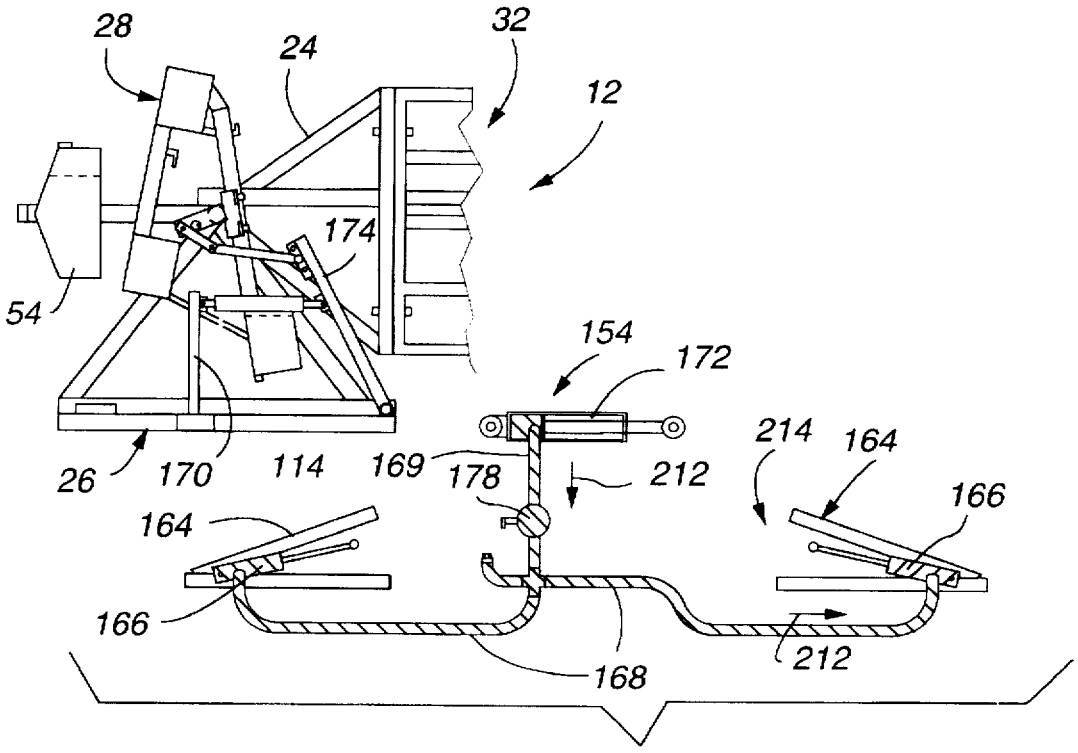
Figure 15:
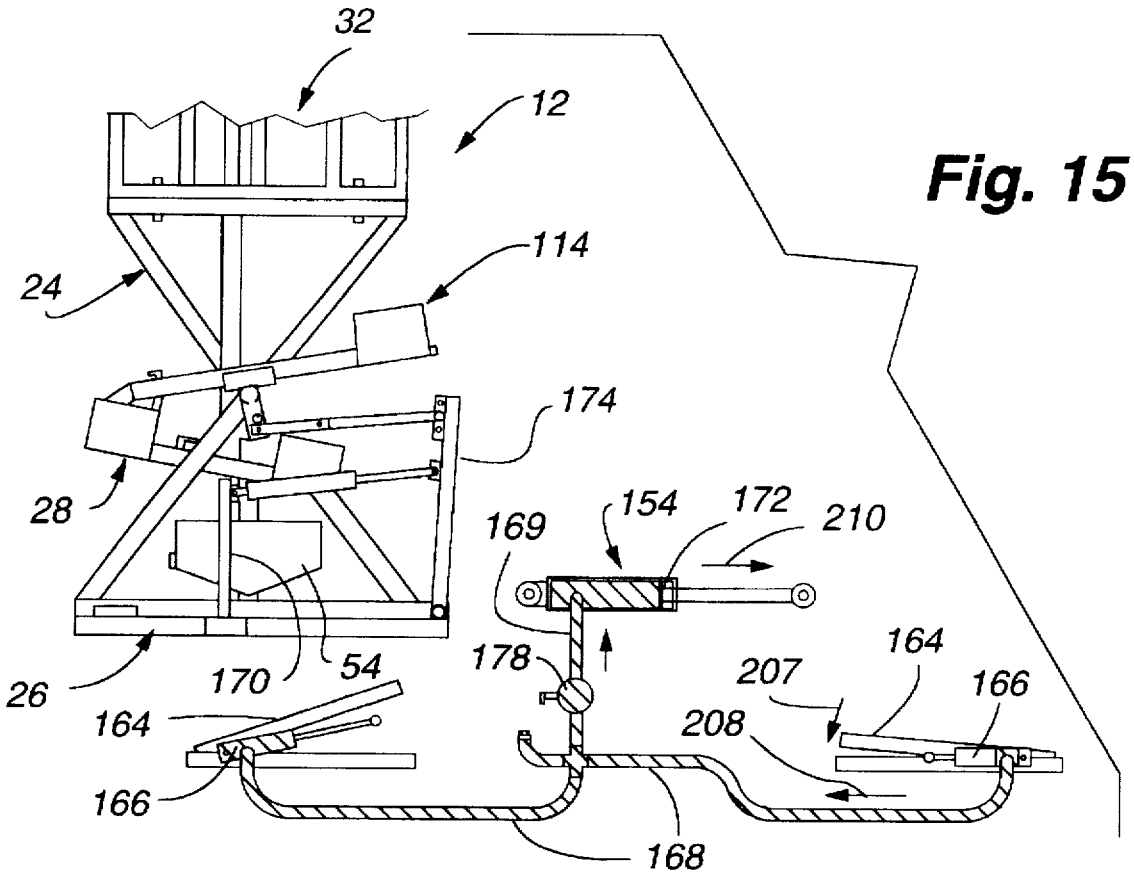

FIGS. 11, 12, and 13 are side elevational schematic views showing the use and operation of the fence gate opener with fluid gravity closure assembly used with the mechanical actuator treadle assembly; and FIGS. 14 and 15 are schematic diagrams showing the use and operation of the fence gate opener with fluid gravity closure assembly used with the hydraulic actuator treadle assembly.

The following is a discussion and description of preferred specific embodiments of the fence gate opener with fluid gravity closure assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Figure 1:
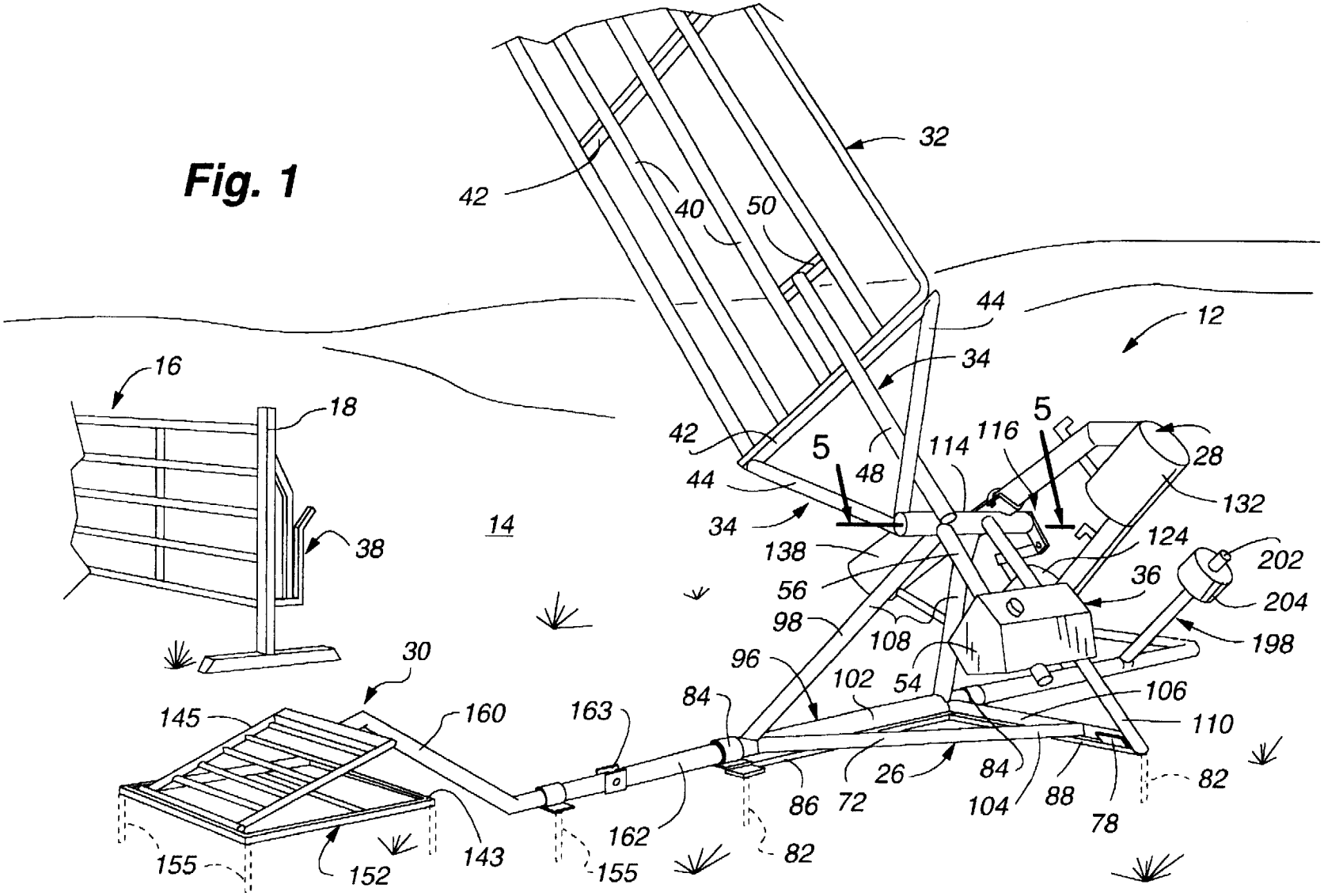
FIG. 1 is a fragmentary perspective view of a fence gate opener with fluid gravity closure assembly of this invention mounted on a ground support surface being extended between a fence assembly with a main gate assembly illustrated in a partially opened condition.

On referring to the drawings in detail, and in particular to FIG. 1, a fence gate opener with fluid gravity closure assembly of this invention, indicated generally at 12, is utilized to be connected to a ground support surface 14 and placed between a fencing assembly 16 connected to at least one fence post member 18 to open and close an open area between spaced fence posts 18.

Figure 7:
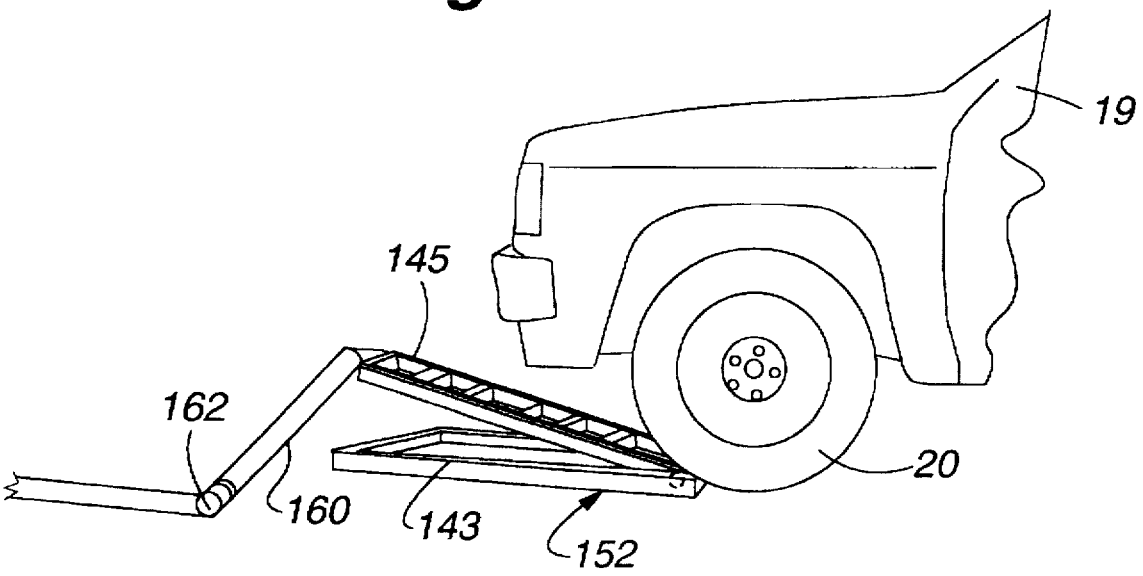
FIG. 7 is a side elevational view of a vehicle approaching the mechanical actuator treadle assembly.

The fence gate opener with fluid gravity closure assembly 12 is provided with a gate actuator treadle assembly which is operable to be moved from an inactive to an active position on receiving a vehicle front tire member 20 from a vehicle 19 thereon (FIG. 7).

The fence gate opener with fluid gravity closure assembly 12 includes 1) a main closure gate assembly 24 to close the open area between the spaced fence posts 18; 2) a main support base assembly 26 connected to the ground support surface 14 and operably connected to the main closure gate assembly 24; 3) a fluid gravity closure assembly 28 operable to pivotally move with the main closure gate assembly 24 about a portion of the main support base assembly 26; and 4) a gate actuator treadle assembly 30 being operably connected to the fluid gravity closure assembly 28 and interconnected main closure gate assembly 24 to cause pivotal movement thereof about a portion of the main support base assembly 26 in a manner to be explained.

The main closure gate assembly 24 includes 1) a main gate assembly 32 resembling a conventional gate member to keep cattle and the like within a fenced area; 2) a pivot support assembly 34 connected to the main gate assembly 32 and to a portion of the fluid gravity closure assembly 28; and 3) a counterbalance weight assembly 36 connected to a portion of the fluid gravity closure assembly 28 so as to be rotatable therewith; and 4) a gate guide and support assembly 38 connected to the fence post 18 at which the main gate assembly 32 initially opens.

The main gate assembly 32 can be constructed of a tubular material, preferably aluminum or light steel tubing and includes 1) a plurality of spaced parallel horizontal support members 40; 2) a plurality of spaced parallel vertical support members 42 secured to the horizontal support members 40; 3) gate sway connectors 44 connected to an outer vertical support member 42; and 4) nut and bolt members 46 are interconnected to a pair of adjacent vertical support members 42. Outer adjacent ends of the gate sway connectors 44 are secured as by welding to a portion of the fluid gravity closure assembly 28 as will be explained.

The pivot support assembly 34 is of generally T-shape having a main connector shaft or channel 48 connected at one end to a vertical support member 50 and having at an outer end an outer connector section 52.

The vertical support member 50 is connected as by welding or bolt members to adjacent ones of the horizontal support members 40 to achieve a rigid and adjustable connection thereto.

A portion of the main connector shaft 48 may be secured as by nut and bolt members 46 at adjacent portions of the vertical support members 42 to add rigidity thereto.

The outer connector section 49 is secured by a clamp member or welding to a portion of the fluid gravity closure assembly 28 in a manner to be described.

Figure 5:
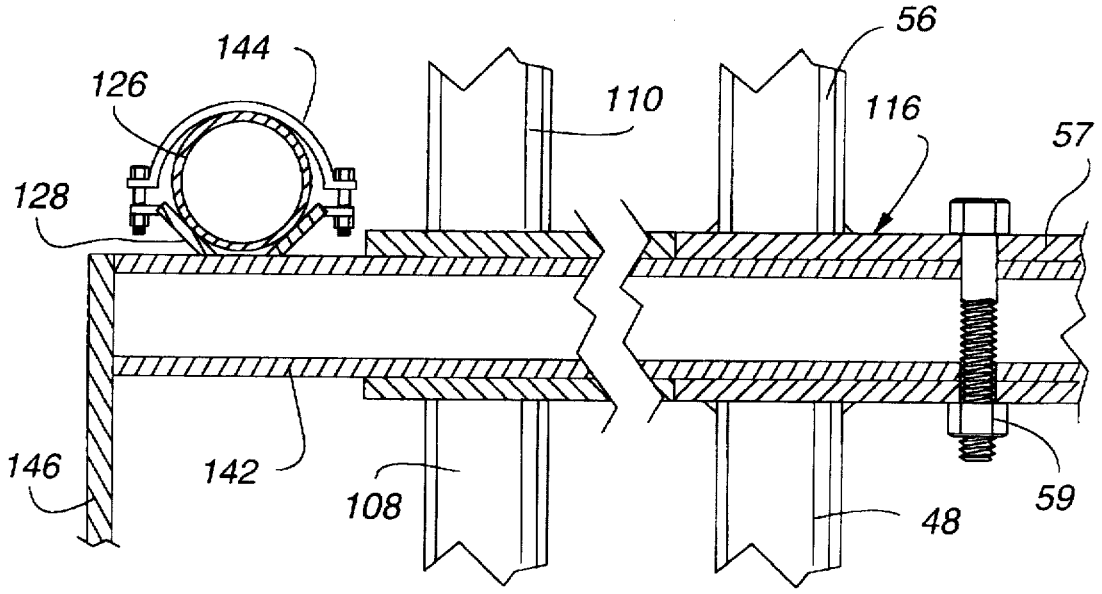
FIG. 5 is an enlarged fragmentary foreshortened view taken along line 5—5 in FIG. 1.

The counterbalance weight assembly 36 is provided with a counterbalance tank member 54 connected to a tank support shaft or channel 56 having one end connected to a shaft connector sleeve 57 which is secured by a nut and bolt member 59 to a pivotal shaft member so as to be rotatable therewith (FIG. 5).

The counterbalance tank member 54 is provided with a drainage valve 61 so can be drained under adverse weather conditions. However, the counterbalance tank member 54 is normally filled with a water and antifreeze solution and adjustably movable axially on the tank support shaft 56. This provides an adjustable and counterbalancing effect at an outer end of the tank support shaft 56 relative to the main gate assembly 32 for ease of opening and closing thereof.

This adjustable feature of the counterbalance tank member 54 is desired as can set the required force needed to be applied against the main gate assembly 32, either through the gate actuator treadle assembly 30 or by a person on foot or horseback, who wishes to raise and lower the main gate assembly 32.

Figure 3:
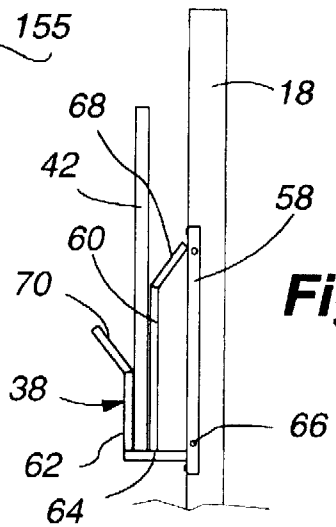
FIG. 3 is a view taken along line 3—3 in FIG. 2.
Figure 4:
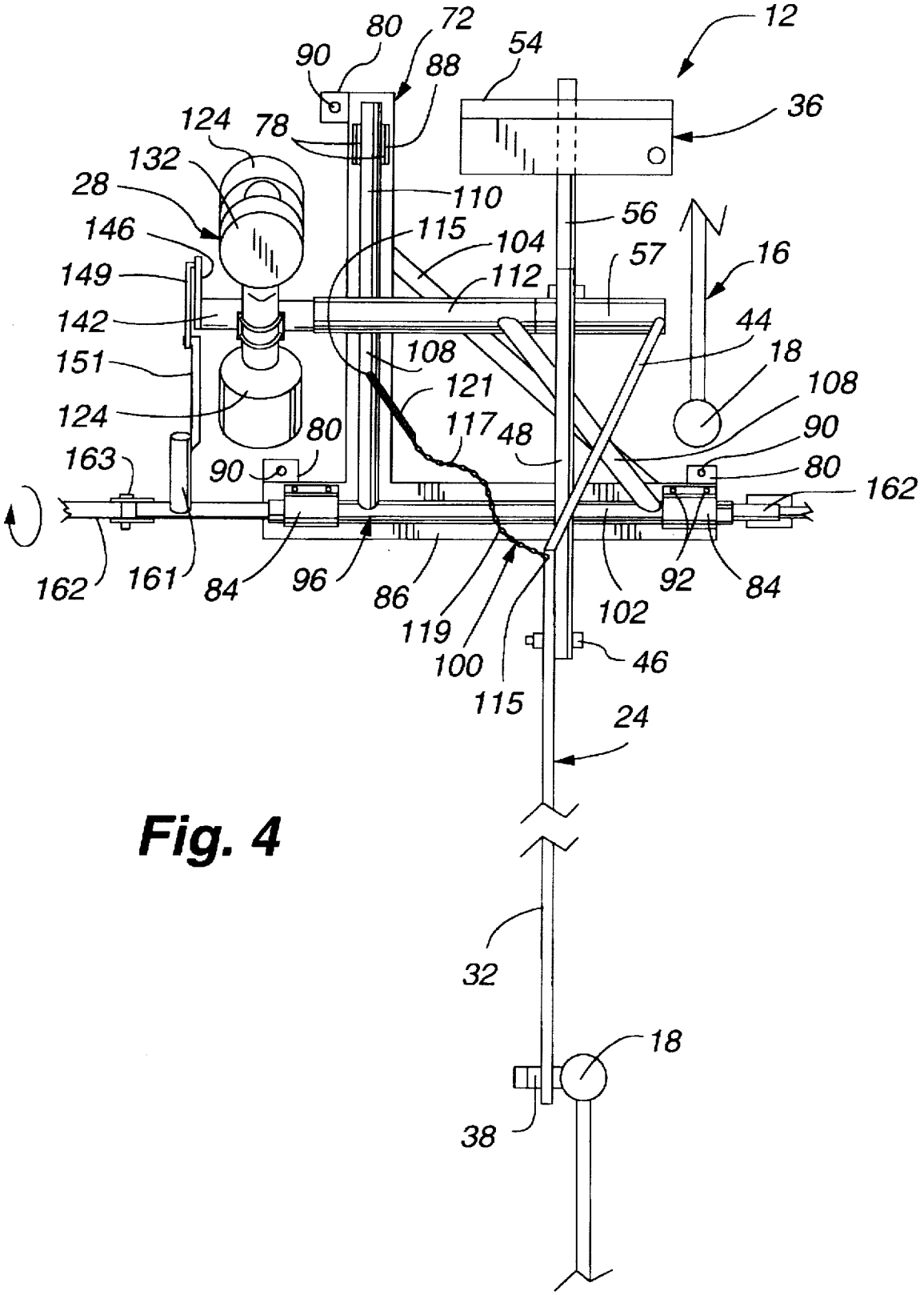
FIG. 4 is a top plan view taken along line 4—4 in FIG. 2.

The gate guide and support assembly or catch bracket assembly 38, as shown in FIG. 3, is secured to the fence post 18. The gate guide and support assembly 38 is provided with a post anchor member 58 having connected thereto 1) a first guide member 60; 2) a second guide member 62; and 3) a lower support section 64 interconnecting the first guide member 60 and the second guide member 62 being operable to receive and support an outer end of the main gate assembly 32 when in the closed condition.

The post anchor member 58 is secured by anchor members 66, being nut and bolt members, to an adjacent one of the support posts 18.

The first guide member 60 includes a first deflector section 68 extended upwardly and outwardly and the second guide member 62 has a second deflector section 70 extended upwardly and outwardly. The first deflector section 68 and the second deflector section 70 form a V-shaped area therebetween which is operable to receive an outer end of the main gate assembly 32 when moved to the closed condition.

The main support base assembly 26 includes 1) a support frame assembly 72 to be anchored in the ground support surface 14; and 2) a gate support pivot assembly 74 pivotally connected to the support frame assembly 72.

The support frame assembly 72 includes 1) a main support channel assembly 76; 2) frame guide plates 78 secured to a rearward portion of the main support channel 76 and extended upwardly therefrom; 3) anchor lugs 80 secured to the main support channel 76; 4) frame stabilizer stakes 82 connected to the anchor lugs 80 for securing to the ground support surface 14; and 5) spaced pivot connector sleeves or members 84 secured to a portion of the main support channel 76.

The main support channel assembly 76 is of L-shape having a forward support member 86 connected to a rearward support member 88 to provide an even, upper support surface having the gate support pivot assembly 74 mounted thereon.

The frame guide plates 78 extend upwardly from the rearward support member 88 and acts as a guide during any bouncing movement on pivotal closing or opening of the main gate assembly 32 in a manner to be described.

The spaced pivot connector sleeves 84 are secured by anchor members 92 which are nut and bolt members connected to the forward support member 86.

It is noted that the frame stabilizer stakes 82 are operable to be placed through anchor holes 90 in the anchor lugs 80 to secure the main support channel assembly 76 to the ground support surface 14.

The gate support pivot assembly 74 includes 1) a horizontal support assembly 96 which is pivotally connected through the pivot connector sleeves 84 to the support frame assembly 72; and 2) a vertical support assembly 98 which is connected to the horizontal support assembly 96 and pivotally movable therewith during a shock absorbing condition on opening and closing of the main gate assembly 32 as will be explained.

The horizontal support assembly 96 is preferably of tubular construction having 1) a main support member 102 pivotally mounted within the pivot connector sleeves 84 on the support time assembly 72; 2) a transverse support member 104 having one end connected to the main support member 102; and 3) a guide support member 106 connected at one end to the horizontal support assembly 96 and another end is connected to an outer end of the transverse support member 104 to achieve a rigid interconnection therebetween and being pivotal about a longitudinal axis of the main support member 102.

The vertical support assembly 98 of tubular construction includes 1) a pair of forward support members 108 having their lower ends secured to respective outer ends of the main support member 102; 2) a rearward support member 110 connected to an outer end of the guide support member 106; 3) an upper horizontal main gate pivot support member 112 which is secured to upper ends of the forward support members 108 and the rearward support member 110 to provide a rigid structure; and 4) a gate bias assembly 100 mounted between a foward support member 108 and an adjacent portion of the main gate assembly 32.

The gate bias assembly 100 includes anchor members 115 with a bias member 117 mounted therebetween. The anchor members 115 are secured to respective portions of the forward support members 108 and the main gate assembly 32.

The bias member 117 is adjustable in length and has a chain section 119 connected to a spring section 121. The spring section 121 is operable to bias the main gate assembly 32 from the opened condition to the closed condition as will be explained.

The main gate pivot support member 112 is operable to receive a pivot shaft member therein as will be described connected to the main gate assembly 32 and the fluid gravity closure assembly 28 which are pivotal thereabout during a gate opening and closing operation as will be described.

The fluid gravity closure assembly 28 includes 1) a weight transfer fluid tank assembly 114; and 2) a pivot shaft connector assembly 116 connected to the weight transfer fluid tank assembly 114 and the main gate pivot support member 112 of the vertical support assembly 98 of the gate support pivot assembly 74.

Figure 2:
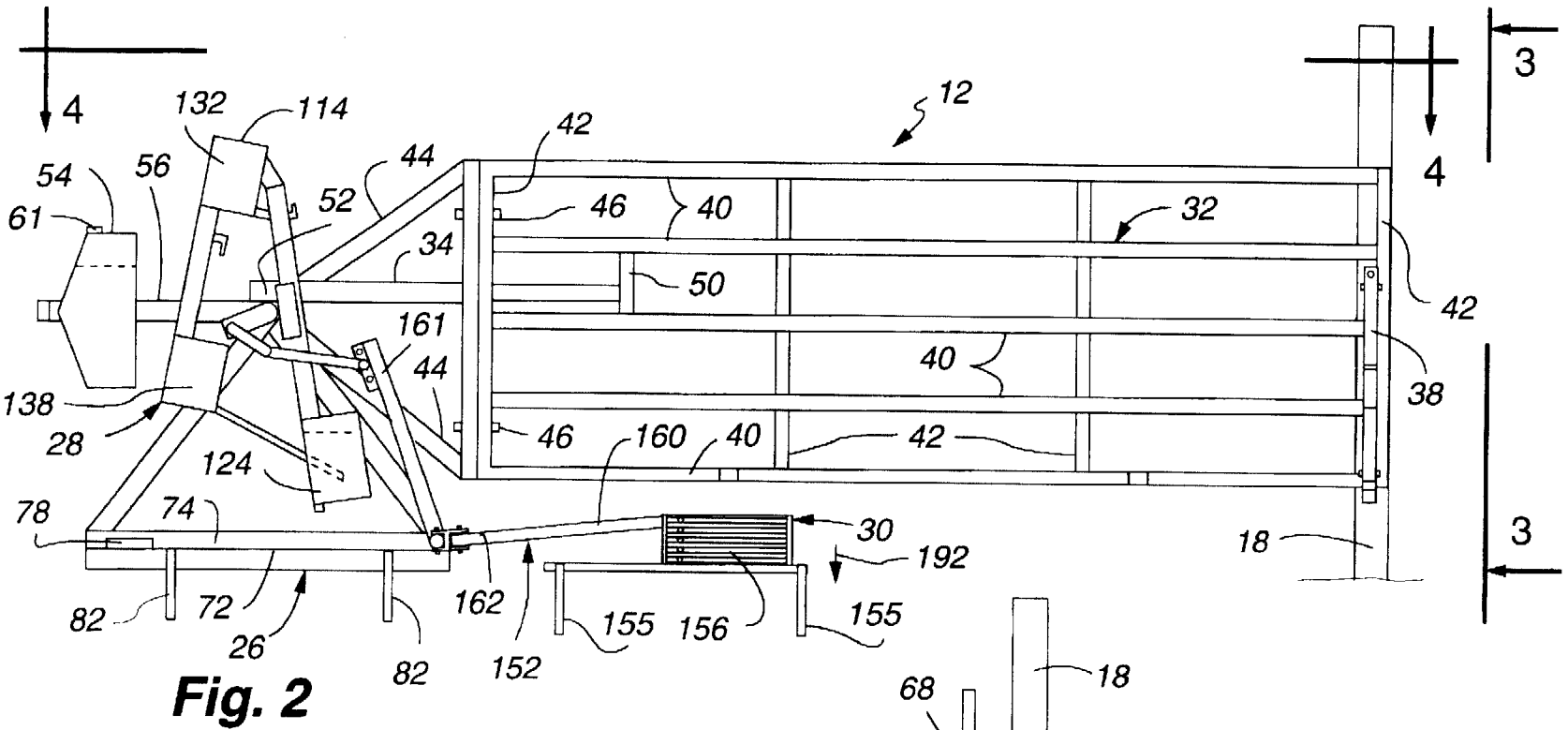
FIG. 2 is an elevational view thereof with the main gate assembly illustrated in a closed position.

The weight transfer fluid tank assembly 114 is an enclosed fluid flow system using the force of gravity to move a fluid, namely water with an antifreeze additive, to 1) hold the main gate assembly 32 in the closed condition as shown in FIG. 2; 2) hold the main gate assembly 32 in the opened condition as shown in FIGS. 13, and 15; and 3) move the main gate assembly 32 from the opened condition to the closed condition in a controlled adjustable manner.

The weight transfer fluid tank assembly 114 includes 1) a main fluid storage tank assembly 118; 2) a main fluid holding tank assembly 120; and 3) a main fluid auxiliary tank assembly 122, all interconnected to each other in a closed fluid flow condition.

The main fluid storage tank member 118 includes 1) a main storage tank member 124 having a drain plug member 131; 2) a storage tank transfer tube or pipe, 126 connected to the main storage tank member 124; 3) a main support bracket assembly 128 connected to a mid portion of the storage tank transfer tube 126 and operable to be secured to the pivot shaft connector assembly 116; 4) a drainage pipe member 129; and 5) a fluid filler plug 130.

Figure 6:
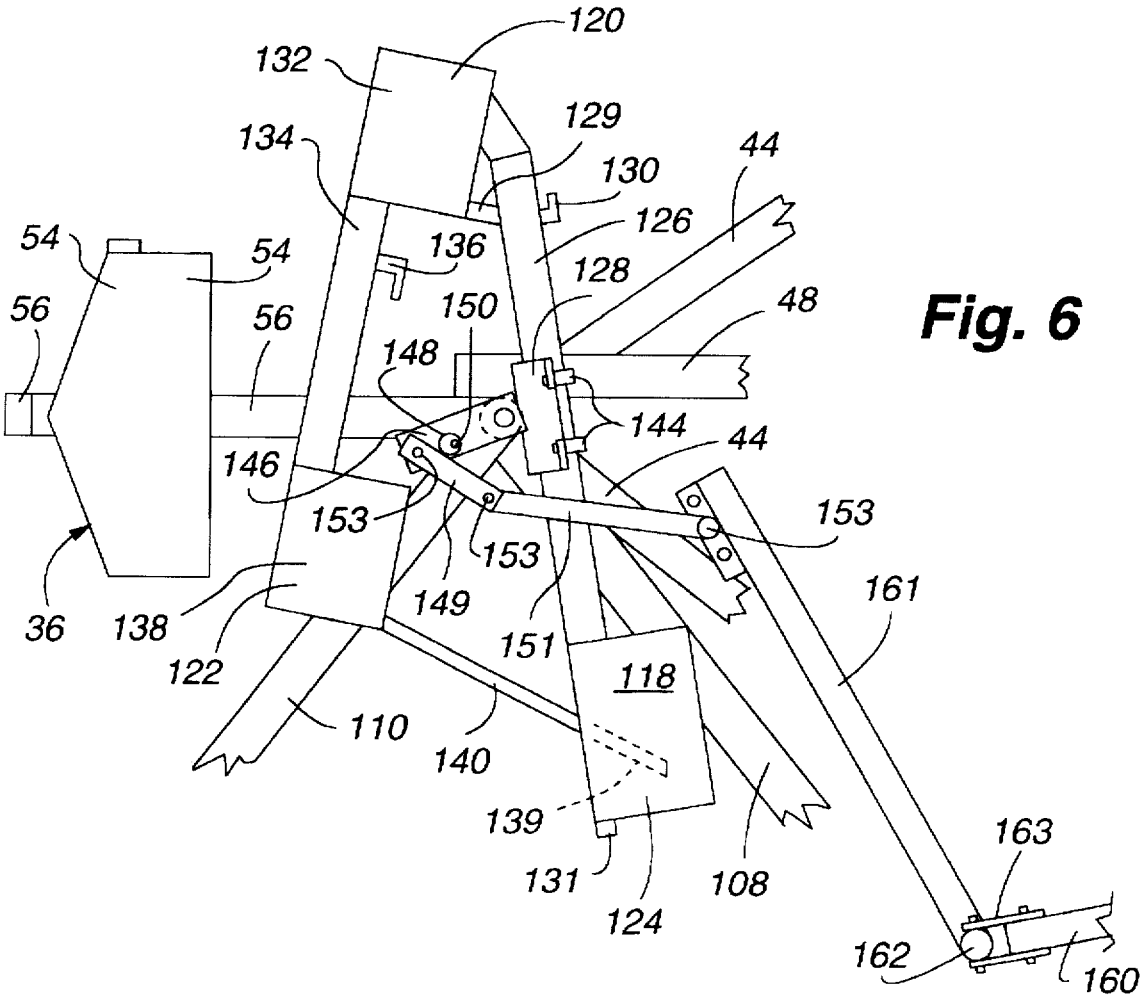
FIG. 6 is a fragmentary side elevational view illustrating linkage interconnection for movement of the main gate assembly through a mechanical actuator treadle assembly.

The drainage pipe member 129 is connected to the main fluid holding tank assembly 120 to allow fluid flow through the storage tank transfer tube 126 into the main storage tank member 124 when in the gate closed condition as noted in FIG. 6. This would not occur if this drainage pipe member 129 was not present.

The main fluid holding tank assembly 120 includes 1) a main holding tank member 132 connected to one end of the storage tank transfer tube 126; 2) a holding tank transfer tube or pipe 134 connected to the main holding tank member 132; and 3) a closure control valve member 136 mounted within the holding tank transfer tube 134 and operable to adjustably vary an orifice therein to control fluid flow from the main holding tank member 132 to the main fluid auxiliary tank assembly 122 in a manner to be explained.

The main fluid auxiliary tank assembly 122 includes 1) a main auxiliary tank member 138 connected to one end of the holding tank transfer tube 134; 2) an auxiliary tank transfer tube or pipe 140 connected to the main auxiliary tank member 138 and the main storage tank member 124 of the main fluid storage tank assembly 118.

The auxiliary tank transfer tube 140 has an outer end section 143 which is extended inwardly within the main storage tank member 124 of the main fluid storage tank assembly 118 so as to be placed adjacent an outer wall of the main storage tank member 124. This is important in the operation thereof to prevent fluid flow within the auxiliary tank transfer tube 140 into the main auxiliary tank member 138 when in the opened condition as noted in FIGS. 13 and 15. This is to assure that fluid will flow from the main storage tank member 124 downwardly into the main holding tank member 132 and through the closure control valve member 136 to control the operating speed of the main gate assembly 32 moving from the opened to the closed conditions.

As shown collectively in FIGS. 5 and 6, the pivot shaft connector assembly 116 includes 1) a main pivot shaft member 142 being rotatably mounted within the main gate pivot support member 112 and, at an outer end, connected to the shaft connector sleeve 57 of the counterbalance weight assembly 36 so as to be conjointly rotatable therewith; 2) a connector clamp member 144 which is secured by nut and bolt members to the main support bracket member 128 on the storage tank transfer tube 126 which then is concurrently rotatable with pivotal movement of the pivot shaft member 142; 3) a shaft connector member 146 connected to an outer end of the pivot shaft member 142; 4) a cam eccentric member 148 connected to the shaft connector member 146; 5) a first pivot arm or link 149 pivotally connected by a pivot shaft 153 to an outer end of the shaft connector member 146; and 6) a second pivot arm or link 151 connected by a pivot shaft 153 to an outer end of the first pivot arm 149.

The cam eccentric member 148 has a hole drilled offset from center and connected to the shaft connector member 146 by a cam bolt member 150. The cam eccentric member 148 is pivotally mounted on the cam bolt member 150 and operable to be rotated to adjust relative distances between the shaft connector member 146 and the first pivot arm 149. This achieves an adjustable pivotal movement of the pivot shaft member 142 and interconnected fluid gravity closure assembly 28 and the counterbalance weight assembly 36 which are jointly connected and rotatable with the pivot shaft member 142.

The gate actuator treadle assembly 30 is provided with two embodiments being 1) a mechanical actuator treadle assembly 152; and 2) a hydraulic actuator treadle assembly 154 as noted in FIGS. 9, 10, 14, and 15.

The mechanical actuator treadle assembly 152 includes 1) a main treadle frame assembly 156; 2) a roller actuator assembly 158 connected to the main treadle frame assembly 156; 3) an actuator arm member 160 connected to the roller actuator assembly 158; 4) a pivotal support post 161 pivotally connected to the second pivot arm 151 on the pivotal shaft connector assembly 116; and 5) a drive line shaft or member 162 which is connected at one end to the actuator arm member 160 and having the pivotal support post 161 connected thereto.

The main treadle frame assembly 156 includes 1) a support frame member 143 secured as by stake members 155 to the ground support surface 14; and 2) a pivotal actuator member 145 which is pivotally connected to one end of the support frame member 143.

The pivotal actuator member 145 is moved from an inclined non-operated condition of FIG. 7 to a depressed condition due to the weight of the vehicle front tire member 20 and the vehicle 19 thereon. This would cause pivotal movement of the actuator arm member 160; rotation of the drive line shaft 162; and rotational movement of the pivot shaft member 142 due to connection to the shaft connector member 146. This will cause pivotal movement of the main gate assembly 32, the counterbalance weight assembly 36, and the fluid gravity closure assembly 28 to the opened condition as noted in FIG. 13.

Figure 8:
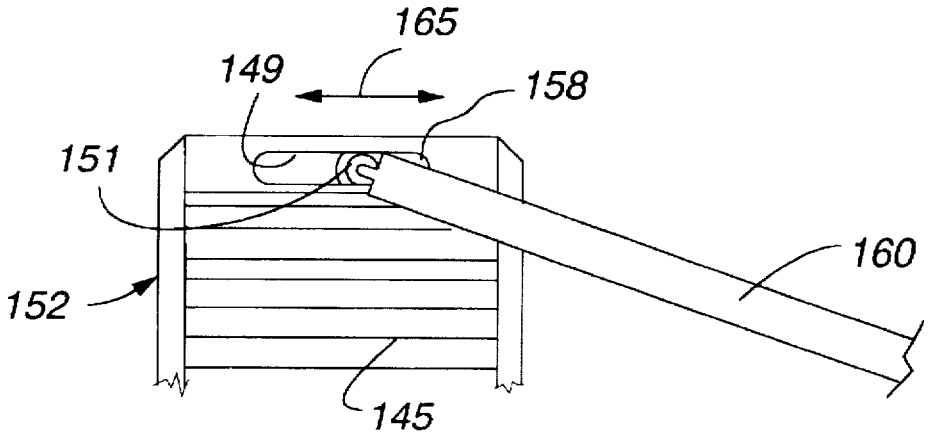
FIG. 8 is a fragmentary front elevational view illustrating movement of a portion of the mechanical actuator treadle assembly on placing a vehicle front tire member thereon.

The roller actuator assembly 158 includes an actuator roller member 151 connected to the actuator arm member 160. The actuator roller member 151 is movable laterally in an actuator slot 149 as shown by an arrow 165 in FIG. 8.

Depression of the pivotal actuator member 145 causes downward movement and the actuator roller member 151 is movable laterally within the actuator slot 149. This causes a downward pivotal movement of the actuator arm member 160 which concurrently rotates the pivotal support post 161 and interconnected drive line shaft 162 through a drive shaft connector 163 to cause opening of the main gate assembly 32 in a manner to be explained.

The hydraulic actuator treadle assembly 154 includes 1) a main hydraulic treadle frame assembly 164; 2) a piston and cylinder actuator assembly 166 connected to the main treadle frame assembly 164; 3) a transfer hose member 168 connected to the piston and cylinder actuator assembly 166; 4) a main support post 170 connected to the main support base assembly 26; 5) a pivotal piston and cylinder actuator assembly 172 having one end pivotally connected to the main support post 170; 6) an actuator post member 174 pivotally connected to the main support base assembly 26 and pivotally connected to the pivotal piston and cylinder actuator assembly 172; and 7) an upper end of the actuator post member 174 is pivotally connected to the first pivotal arm 149 on the pivotal shaft connector assembly 116.

There is provided a common actuator hose member 169 to interconnect respective ones of the piston and cylinder actuator assemblies 166 and the pivotal piston and cylinder actuator assembly 172. A restrictor valve 178 is mounted within the common actuator hose member 169 for controlled operation as will be explained.

As shown in FIG. 10, the main treadle frame assembly 164 includes 1) a support frame member 180 secured to the ground support surface 14 by stake members 155; 2) a pivotal actuator member 182 pivotally connected to the support frame member 180; and 3) a pivotal roller assembly 184 connected between an upper end of the pivotal actuator member 182 and the piston and cylinder actuator assembly 166. An actuator plate 185 is connected to the support frame member 180 and engageable with the pivotal roller assembly 184 on downward pivotal movement of the pivotal actuator member 182 as noted by an arrow 196. This pivotal movement causes axial rearward movement of the piston and rod member of the piston and cylinder actuator assembly 166 as noted by an arrow 198 in FIG. 10.

The actuator assemblies 166 and 172 are known in the prior art having a piston/rod member selectively movable within a cylinder member under fluid pressure.

USE AND OPERATION OF THE INVENTION

In the use and operation of the fence gate opener with fluid gravity closure assembly 12 of this invention, it can be easily shipped in a semi-assembled condition with the following elements being 1) the main closure gate assembly 24 with the main gate assembly 32 and the counterbalance weight assembly 36 along with the gate guide and support assembly 38 which can be assembled on site; 2) the main support base assembly 26 which can be shipped in the assembled condition; 3) the fluid gravity closure assembly or closure means 28 which can be shipped in two pieces being the weight transfer fluid tank assembly 114 and the pivot shaft connector assembly 116; and 4) the gate actuator treadle assembly or actuator means 30 can be shipped with either the mechanical actuator treadle assembly 152 or the hydraulic actuator treadle assembly 154 and normally two each thereof would be shipped so as to be placed on opposite sides of the main gate assembly 32 so as to be operated and opened by vehicles approaching from opposite sides of the main gate assembly 32.

We will assume the assembled condition of FIG. 1 whereupon 1) the gate guide and support assembly 38 has been connected to the fence post 18 to provide a gate closed support means and the main gate assembly 32 is placed in a closed condition. The support frame assembly 72 has the main support channel assembly 76 anchored by frame stabilizer stakes 82 to a proper ground position on the ground support surface 14.

Next, the gate support pivot assembly 74 is pivotally connected to the forward support member 86 of the support frame assembly 72 so as to permit shock absorbing pivotal movement thereabout.

The main gate assembly 32 with the pivotal support assembly 34 and the outer connector section 52 are secured as by welding to the shaft connector sleeve 57 which is anchored by a nut and bolt member 59 to the pivot shaft member 142.

As shown in FIG. 5, the pivot shaft connector assembly 116 has the pivot shaft member 142 mounted within the main gate pivot support member 112. The pivot shaft connector assembly or linkage means 116 is secured by the connector clamp member 144 to the main support bracket assembly 128 on the storage tank transfer tube connector 126 of the main fluid storage tank assembly 118.

Next, the shaft connector member 146 is pivotally connected to the first pivot arm 149 by the pivot shaft 153 and the second pivot arm 151 is pivotally connected to the first pivot arm 149 by another pivot shaft 153. An outer end of the second pivot arm 151 is pivotally connected by a pivot shaft 153 to the respective actuator post member 174 or the pivot support post 161 depending on whether utilized on a mechanical or hydraulically operated treadle assembly.

The mechanical actuator treadle assembly 152 or the hydraulic actuator treadle assembly 154 is placed in spaced desired locations on opposite sides of the main gate assembly 32 and can be anchored to the ground support surface 14 through use of anchor stakes 155 or the like.

On use of the mechanical actuator treadle assembly 152, the main treadle frame assembly 156 is interconnected by the actuator arm member 160 to the drive line shaft 162 which, in turn, would rotate the pivotal support post 161 on being operated through downward movement of the pivotal actuator member 145 of the main treadle frame assembly 156.

On use of the hydraulic actuator treadle assembly 154, the main treadle frame assembly 156 will be anchored as by anchor stakes 155 to the proper positions on opposite sides of the main gate assembly 32. The transfer hose members 168 would be connected from the respective piston and cylinder actuator assemblies 166 to the common actuator hose member 169 for fluid flow through the restrictor valve 178 to the pivotal piston and cylinder actuator assembly 172.

On use of the fence gate opener with fluid gravity closure assembly 12 with the mechanical actuator treadle assembly 152 as noted in FIG. 2, downward movement of the pivotal actuator member 145 would move the actuator arm member 160 downwardly as noted by an arrow 192. This would cause rotation of the drive line shaft 162 through the drive shaft connector 163. Further, this would cause outward pivotal movement of the pivotal support post 161 which would then cause rotational movement of the pivot shaft member 142 and cause rotation of the main gate assembly 32 to the opened condition as noted in FIG. 13.

On this initial upward movement of the main gate assembly 32 as noted in FIG. 12, the fluid contained within the weight transfer fluid tank assembly 114 would move under the force of gravity from the main storage tank member 124 through the storage tank transfer tube or pipe 126 downwardly into the main holding tank member 132. This immediately causes a fluid flow and weight transfer over a pivot center axis of the pivot shaft member 142 to the condition as shown in FIG. 13.

Due to the part of the auxiliary tank transfer tube 140 being extended upwardly and having the end section 139 adjacent the outer wall of the main storage tank member 124, the fluid flow is unable to flow backwardly through the auxiliary tank transfer tube 140 into the main auxiliary tank member 138. Instead, the fluid therein would flow into the main holding tank member 132 and in a controlled manner through the closure control valve member 136 into the main auxiliary tank member 138.

The closure control valve member 136 can be adjusted to regulate the rate of fluid flow from the main holding tank member 132 into the main auxiliary tank member 138 in a controlled manner. Depending on the rate of fluid flow allowed, eventually the fluid flow into the main auxiliary tank member 138 would then cause a gradual subsequent movement of the main gate assembly 32, as shown in FIG. 12, towards the closed condition of FIG. 11. The weight of the fluid in the main auxiliary tank member 138 relative to the axis of the pivot shaft member 142 causes closure of the main gate assembly 32.

In the closed condition, the fluid would have flowed downwardly into the main storage tank member 124 to assist in holding in the closed condition of FIG. 11. In this condition, it is noted that fluid is present in the counterbalance tank member 54 which balances with the overall weight of the main gate assembly 32 to hold in the closed condition.

The counterbalance weight assembly 36 can be adjusted on the tank support shaft 56 and by the amount of fluid therein to determine the amount of force to be applied to the outer end of the main gate assembly 32 to cause opening thereof.

By proper adjustment of the counterbalance weight assembly or counterbalance means 36, only a small amount of pressure on the outer end of the main gate assembly 32 would be necessary by a person on foot or horseback to open same to allow cattle and other items therethrough.

When in the opened condition of FIG. 13, the closure control valve member 136 can be closed, thus preventing fluid flow back into the main auxiliary tank member 138. Therefore, the fluid within the main holding tank member 132 would hold the main gate assembly 32 in the opened condition as shown in FIG. 13. The closure control valve member 136 can be selectively opened at any time to move the main gate assembly 32 to the closed condition of FIG. 11 by fluid flow transfer as previously described.

In the operation of the fence gate opener with fluid gravity closure assembly 12 with the hydraulic actuator treadle assembly 154 as shown in FIGS. 14 and 15, it is to be noted that operation of the fluid flow within the weight transfer fluid tank assembly 114 is identical as previously described utilizing the mechanical actuator treadle assembly 152. The main difference, as noted in FIGS. 14 and 15, is whereby depression of either one of the pivotal actuator members 182, as shown by an arrow 207, would cause movement of a piston and rod member within one of the piston and cylinder actuator assemblies 166 to cause fluid flow, as shown by an arrow 208, in the transfer hose member 168. This would then operate to extend a piston and rod member, as shown by an arrow 210, within the pivotal piston and cylinder actuator assembly 172. This would then operate to pivot the actuator post member 174, as noted in FIG. 15, to raise the main gate assembly 32 to the vertical or opened condition. The operator of the vehicle then would proceed forwardly from the actuated hydraulic actuator treadle assembly 154 and proceed to drive around the other hydraulic actuator treadle assembly 154.

The main gate assembly 32 can be held in this opened condition on closing of the closure control valve member 136. However, during automatic operation, fluid within the weight transfer fluid tank assembly 114 would flow from the main storage tank member 124 into the main holding tank member 132 and the closure control valve 136 into the main auxiliary tank member 138.

At this time, the main gate assembly 32 would start to pivot from the opened towards the closed condition which would, by weight thereof, force the piston and rod member of the pivotal piston and cylinder actuator assembly 172 to move to the position as shown by arrows 212 in FIG. 14. The resultant fluid flow would cause the main treadle frame assembly 164 that was depressed to move to the inactivated condition, as shown by an arrow 214, waiting for another cycle of operation to open the main gate assembly 32.

In the normal operation, the restrictor valve 178 is provided with an adjustable orifice therein which would control the speed of closing of the main gate assembly 32 which may work independently or in conjunction with the closure control valve member 136 on the main holding tank member 132 for the same purpose.

As shown in FIG. 1, the fence gate opener with fluid gravity closure assembly 12 is provided with an adjustable counterbalance assembly 198 connected to a portion of the rotatable drive line shaft 162. The adjustable counterbalance assembly 198 is used with main gate assemblies 32 of considerable weight to adjust force necessary to open the main gate assembly 32.

The adjustable counterbalance assembly 198 includes a support shaft 202 having one end secured to the drive line shaft 162 and the counterbalance tank 204 adjustably mounted on the support shaft 202. The counterbalance tank 204 can be filled with a fluid and axially movable on the support shaft 202 to achieve a desired counterbalancing feature with the main gate assembly 32 in conjunction with the counterbalance weight assembly 36.

The gate bias assembly 100 operates with the spring section 121 to bias the main gate assembly 32 in a clockwise direction from the opened condition to the closed condition as shown in FIG. 13. This cooperates with the gravity fluid flow to achieve the gate closed position as shown in FIG. 11.

The cam eccentric member 148 being adjustably mounted on the cam bolt member 150 is important because a limited height of the main treadle frame assembly 156 or the main hydraulic treadle frame assembly 164 is about 16 inches. The cam eccentric member 148 allows the main gate assembly 32 to be pivoted 90 degrees from the closed condition by lightweight vehicle such as All Terrain Vehicles (ATV's) depressing subject treadle assemblies 156, 164.

In a gate closed position, there is a distance of 4¼ inches from an axis of the pivot shaft member 142 to the outer pivot shaft 153 of the first pivot arm 149. The center of gravity of the main storage tank member 124 is a distance of 10½ inches which achieves a leverage effect of 2.47 to 1 or 10½ divided by 4¼.

Initial depression of the treadle assemblies 156, 164 pivots the first pivot arm 149 and the shaft connector member 146 together to rotate the pivot shaft member 142.

On reaching movement of the main gate assembly 32 to approximately 42 degrees of being opened, the cam eccentric member 148 no longer contacts the first pivot arm 149 and the leverage ratio changes with a distance from the axes of the pivot shaft member 142 to the outer pivot shaft 153 being 5¼ inches. At this time, the center of gravity of the main storage tank member 124 is a distance of 21 inches. This achieves a leverage effect of 4 to 1 or 21 divided by 5¼.

In the opened position, the distance from an axis of the pivot shaft member 142 to the center axis of the outer pivot shaft 153 is 6½ inches. At this time, the center of gravity of the main storage tank member 124 to the axis of the pivot shaft member 42 is 24 inches. This achieves a leverage effect of 3.7 to 1 or 24 divided by 6½.

This increased leverage from 2.47 to 1.0 to 4.0 to 1 is important in allowing the main gate assembly 32 to be opened by lightweight vehicles.

This change in leverage is important in moving the main gate assembly 32 from the opened to the closed position to achieve a controlled closing thereof.

The gate bias assembly 100 connected to the drive line shaft 162 is used to assist in closing the main gate assembly 32 when heavy duty and weight treadle assemblies 152, 154 are used for heavier vehicles such as loaded eighteen wheelers, semi-trailer tracks, etc.

The gate bias assembly 100 is inclined outwardly from a central axis of the drive line shaft 162 to provide a force to return subject treadle assemblies 152, 154 to the inactive positions.

The fence gate opener with fluid gravity closure assembly is readily transported to remote locations and provides an automatic gate opening operation without use of external power sources.

The fence gate opener with fluid gravity closure assembly can be utilized with hydraulic actuator treadle assemblies so it can be installed on irregular or rough terrain.

Further, the fence gate opener with fluid gravity closure assembly is easy to install; economical to manufacture; safe in operation; self-contained; and substantially maintenance free.

While the invention has been described in conjunction with preferred specific embodiments thereof, it will be understood that this description is intended to illustrate and not to limit the scope of the invention, which is defined by the following claims:

We claim:

1. A fence gate opener with fluid gravity closure assembly, comprising:

a) a main closure gate assembly includes a main gate assembly movable from a horizontal gate closed position to an upper gate opened position;

b) said main gate assembly pivotally connected to a main support base assembly;

c) a fluid gravity closure assembly connected to and movable with said main gate assembly;

d) actuator means operably connected to said main gate assembly;

e) said actuator means engaged by a portion of a vehicle operable to move said main gate assembly from a closed to an opened position;

f) said fluid gravity closure assembly operable when said main gate assembly is in the opened position to cause fluid flow therein to cause said main gate assembly to move to the closed position;

g) said fluid gravity closure assembly includes a weight transfer fluid tank assembly having a fluid therein;

h) said weight transfer fluid tank assembly includes 1) a main storage tank member containing said fluid when said main gate assembly is in the closed position; and 2) a main holding tank member containing said fluid when said main gate assembly is in the opened position;

i) said main holding tank member spaced from the main storage tank member mid connected thereto by a storage tank transfer tube operable to transfer said fluid therebetween; and j) said weight transfer fluid tank assembly includes a main auxiliary tank member operably connected to said main storage tank member and said main holding tank member to permit said fluid to move in a controlled manner through a control means from said main holding tank member to said main auxiliary tank member to start a controlled movement of said main gate assembly from the opened to the closed position.

2. A fence gate opener with fluid gravity closure assembly as described in claim 1, wherein:

a) said control means is a control valve mounted in a holding tank transfer tube mounted between said main holding tank member and said main auxiliary tank member to control the rate of fluid flow by said fluid therebetween.

3. A fence gate opener with fluid gravity closure assembly as described in claim 1, wherein:

a) said main auxiliary tank member connected to said main storage tank member by an auxiliary tank transfer tube connected to said main storage tank member operable to permit said fluid to flow into said main storage tank assembly when said main gate assembly is moving from the opened to the closed position.

4. A fence gate opener with fluid gravity closure assembly as described in claim 3, wherein:

a) said auxiliary tank transfer tube having an outer end section extended in said main storage tank member and positioned to minimize flow of said fluid from said main storage tank member to said main auxiliary tank member after movement of said main gate assembly from the closed to the opened position.

5. A fence gate opener with fluid gravity closure assembly as described in claim 1, including:

a) a counterbalance weight assembly connected to and extended in a direction away from said main gate assembly and movable therewith on movement from the closed to the opened position; and b) said counterbalance weight assembly includes a counterbalance tank member adjustably mounted on a support member to control force required to open and close said main gate assembly.

6. A fence gate opener with fluid gravity closure assembly adapted to be mounted between fence posts to allow or prevent access therebetween to a fenced area, comprising:

a) a main gate assembly mountable between a pair of spaced fence posts and selectively movable from a closed to an opened position and back to the closed position;

b) a main support base assembly adapted to be connected to a ground support surface and having said main gate assembly pivotally connected thereto;

c) a closure assembly includes a weight transfer fluid tank assembly having a pivot connector assembly connected to said main support base assembly and said main gate assembly;

d) a gate actuator assembly connected to said pivot connector assembly and to said closure assembly having said gate actuator assembly moved to an actuated position by a tire member on a vehicle to rotate said pivot connector assembly and said weight transfer fluid tank assembly to move said main gate assembly from the closed to the opened position;

e) said closure assembly 1) operable in a first position to hold said main gate assembly in the closed position; and 2) operable in a second position to cause gradual, controlled movement of said main gate assembly from the opened position to the closed position;

f) a counterbalance weight assembly connected to said pivot connector assembly extended in a direction away from said main gate assembly; and g) said counterbalance weight assembly includes a counterbalance member adjustably mounted on a support member, whereby said counterbalance member is selectively movable on said support member to regulate an amount of force needed to open and close said main gate assembly.

7. A fence gate opener with fluid gravity closure assembly as described in claim 6, wherein:

a) an actuator assembly operably connected to said pivot connector assembly;

b) said pivot connector assembly includes a pivot shaft member rotatably mounted to a portion of said main support base assembly and said main gate assembly;

c) said weight transfer fluid tank assembly connected to said pivot shaft member and rotatable therewith; and d) said actuator assembly movable to an actuated position which rotates said pivot shaft member to move said main gate assembly from the opened to the closed position.

8. A fence gate opener with fluid gravity closure assembly as described in claim 7, wherein:

a) said actuator assembly having an actuator treadle assembly moved to said actuated position on receiving a vehicle tire member thereon;

b) said actuator treadle assembly being hydraulically operated with pressure fluid flow from said actuated position operable to rotate said pivot shaft member to move said main gate assembly from the closed to the opened position;

c) said hydraulic actuator treadle assembly includes a piston and cylinder actuator assembly connected to a pivotal actuator member, a transfer base member connected to said piston and cylinder actuator assembly, an actuator hose member connected to said transfer hose member, a restrictor valve mounted in said actuator hose member, and a pivotal piston and cylinder actuator assembly connected to said actuator hose member and said pivot shaft member; and d) depression of said pivotal actuator member operable to transfer the pressure fluid from said piston and cylinder actuator assembly through said restrictor valve to said pivotal piston and cylinder actuator assembly to rotate said pivotal shaft member to move said main gate assembly to the opened position;

whereby said restrictor valve controls flow of the pressure fluid therethrough to achieve a controlled gradual opening of said main gate assembly.

9. A fence gate opener with fluid gravity closure assembly as described claim 8, wherein:

a) said closure assembly includes said weight transfer fluid tank assembly operable in said second position to gradually pivot said main gate assembly toward the closed position; and b) gradual pivotal movement of said main gate assembly creates pressure fluid flow from said pivotal piston and cylinder actuator assembly through said restrictor valve to said piston and cylinder actuator assembly to pivot said pivotal actuator member to a normal non-actuated position on said main gate assembly reaching the closed position.

10. A fence gate opener with fluid gravity closure assembly to be connected to a main gate assembly to cause movement thereof from a closed position to an opened position and to the closed position, comprising:

a) a main support base assembly and a main gate assembly pivotally connected to said main support base assembly for movement from a closed to an opened position;

b) a gate closure assembly operably connected to said main support base assembly and said main gate assembly;

c) said gate closure assembly operable in a first position under a force of gravity to hold said main gate assembly in the closed position;

d) said gate closure assembly operable in a second position by a controlled movement of a fluid under the force of gravity to cause said main gate assembly to move from the opened position to the closed position in a controlled, adjustable amount of time and resultant speed of movement;

e) said gate closure assembly includes a pivot shaft connector assembly rotatably connected to said main support base assembly and a weight transfer fluid tank assembly connected to said pivot shaft connector assembly for rotation therewith;

f) said weight transfer fluid tank assembly includes 1) a first member filled with said fluid to hold said main gate assembly in the closed condition under the force of gravity; and 2) a second member filled with said fluid flowing through a fluid transfer member connected from said first member to said second member to hold said main gate assembly in the opened position under the force of gravity;

g) said weight transfer fluid tank assembly includes a third member connected between said first and said second member; and h) said fluid movable under the force of gravity from said second member to said third member to cause controlled movement of said main gate assembly from the opened to the closed position.

11. A fence gate opener with fluid gravity closure assembly as described in claim 10, wherein:

a) 1) said fluid transfer tube interconnects said first member to said second member; 2) a separate fluid transfer tube interconnects said second member to said third member; and 3) another fluid transfer tube interconnects said third member to said first member;

b) a control valve member is mounted in said separate fluid transfer line between said second member and said third member; and c) said control valve member adjusts rate of fluid flow from said second member to said third member to control the rate and time of movement of said main gate assembly from the opened to the closed position.

12. A fence gate opener with fluid gravity closure assembly as described in claim 11, wherein:

a) said another fluid transfer tube between said first member and said second member having an end section extended within said first member to minimize fluid flow from said first member to said third member when said main gate assembly is pivoted to the opened position.

13. A fence gate opener with fluid gravity closure assembly to be connected to a main gate assembly to cause movement thereof from a closed position to an opened position and to the closed position, comprising:

a) a main support base assembly and a main gate assembly pivotally connected to said main support base assembly for movement from a closed to an opened position;

b) a gate closure assembly operably connected to said main support base assembly and said main gate assembly;

c) said gate closure assembly operable in a first position under a force of gravity to hold said main gate assembly in the closed position;

d) said gate assembly operable in a second position by a controlled movement of a fluid under the force of gravity to cause said main gate assembly to move from the opened position to the closed position in a controlled adjustable amount of time and resultant speed of movement;

e) said gate closure assembly includes a pivot shaft connector assembly rotatably connected to said main support base assembly and a weight transfer assembly connected to said pivot shaft connector assembly for rotation therewith; and f) said weight transfer fluid tank assembly includes 1) a first member filled with said fluid to hold said main gate assembly in the closed condition under the force of gravity; and 2) a second member filled with said fluid flowing through a fluid transfer member connected from said first member to said second member to hold said main gate assembly in the opened position under the force of gravity;

g) said pivot shaft connector assembly includes a cam eccentric member mounted on a shaft connector member and engagable with a first pivotal arm connected to said shaft connector member and operable to achieve an increased leverage effect by engagement of said cam eccentric member with said first pivotal arm to assist in initial opening of said main gate assembly.

14. A fence gate opener with fluid gravity closure assembly as described in claim 13, wherein:

a) said cam eccentric member is adjustably mounted on said shaft connector member in order to increase or decrease a leverage effect used to open and close said main gate assembly.

* * * * *